US006524406B2

(12) United States Patent
Kikuchi et al.

(10) Patent No.: US 6,524,406 B2
(45) Date of Patent: Feb. 25, 2003

(54) SHAPE MEMORY ALLOY

(75) Inventors: Takehiko Kikuchi, Ibaraki (JP); Setsuo Kajiwara, Ibaraki (JP); Daozhi Liu, Ibaraki (JP); Kazuyuki Ogawa, Ibaraki (JP); Norio Shinya, Ibaraki (JP)

(73) Assignee: National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/779,488

(22) Filed: Feb. 9, 2001

(65) Prior Publication Data

US 2001/0023723 A1 Sep. 27, 2001

(30) Foreign Application Priority Data

Feb. 9, 2000 (JP) ..... 2000/032478

(51) Int. Cl.[7] ..... C22C 29/06
(52) U.S. Cl. ..... 148/402; 148/579
(58) Field of Search ..... 148/402, 579

(56) References Cited

U.S. PATENT DOCUMENTS 4,574,016 A * 3/1986 Yamamoto et al. ..... 148/144

FOREIGN PATENT DOCUMENTS

| | | | | |
|---|---|---|---|---|
| DE | 3930340 A1 | * | 3/1981 | ..... C02C/38/36 |
| JP | 05320818 A | * | 12/1993 | ..... C22C/37/06 |
| JP | 01071595 A | * | 3/1996 | ..... B23K/35/32 |
| KR | 2001004102 A | * | 1/2001 | ..... C22C/33/02 |

OTHER PUBLICATIONS

Fujikawa et al. ACS Document No. 108:41999 for JP 62130264 A2, published Jun. 12, 1087. Abstract.*

* cited by examiner

*Primary Examiner*—Roy King
*Assistant Examiner*—Tima McGuthry-Banks
(74) *Attorney, Agent, or Firm*—Wenderoth, Lind & Ponack, L.L.P.

(57) ABSTRACT

A novel shape memory alloy of Fe—Mn—Si system containing at least Fe, Mn, and Si wherein the alloy contains niobium carbide in the structure and is improved in that a sufficiently satisfactory shape memory effect is provided without carrying out a special treatment termed training.

3 Claims, 5 Drawing Sheets

A

B

Shape memory recovery ratio dependence on strain for tensile deformation
①: Fe28Mn6Si5CrNbC ②: Fe15Mn5Si9Cr5NiNbC ④: Fe28Mn6Si5Cr Shape recovery force dependence on shape memory strain A: pre-strain 2.1% for Fe28Mn6Si5CrNbC
B: pre-strain 4.1% for Fe28Mn6Si5CrNbC
C: pre-strain 5.5% for Fe28Mn6Si5CrNbC
D: pre-strain 5.0% for Fe15Mn5Si9Cr5NiNbC
E: pre-strain 3.1% for Fe28Mn6Si5Cr

SHAPE MEMORY ALLOY

FIELD OF THE INVENTION

This invention relates to a shape memory alloy containing niobium carbide and a process for producing the same. More specifically, the invention relates to a novel shape memory alloy of Fe—Mn—Si system that contains niobium carbide and exhibits a sufficiently satisfactory shape memory effect without undergoing training and a process for producing the same.

DESCRIPTION OF THE RELATED ART

Considerable attention has been directed to shape memory alloys in the fields of actuator mechanisms, joint mechanisms, and switch mechanisms or as functional materials having shape-restoring properties in a variety of fields. Application of the shape memory alloys to various fields has been proceeding in recent years.

Shape memory alloys having various compositions have been examined so far. Of these alloys, the shape memory alloys of Fe—Mn—Si system containing Fe, Mn, and Si as principal constituents (furthermore, including Fe—Mn—Si—Cr system and Fe—Mn—Si—Cr—Ni system) have been developed in Japan.

It is worth notice that the shape memory alloys of Fe—Mn—Si system are first discovered in Japan.

However, it is a matter for regret that the alloys of Fe—Mn—Si system are not yet put to practical use. The main cause is that the alloys cannot exert a sufficient shape memory effect without undergoing a particular thermomechanical treatment termed training. The training means herein to repeat a heat treatment several times, which consists of 2—3% deformation and the subsequent heating above the reverse transformation temperature.

Thus, the shape memory alloys of Fe—Mn—Si system in the related art require such troublesome and burdensome training, failing to turn the alloys to practical use.

The invention aims at solving the problem that the shape memory alloys of Fe—Mn—Si system in the related art encounters, and providing an novel shape memory alloy of Fe—Mn—Si system that exhibits a sufficiently satisfactory shape memory effect without undergoing the special treatment termed training.

SUMMARY OF THE INVENTION

In order to solve the aforesaid problems, first, the invention provides a shape memory alloy characterized by containing niobium carbide in the structure in the shape memory alloys of Fe—Mn—Si system containing at least Fe, Mn, and Si as principal constituents.

The invention provides, secondly, the aforesaid shape memory alloy containing further Cr or Cr and Ni as principal constituents, thirdly, the shape memory alloy where niobium carbide is contained in volume ratio of 0.1 to 1.5 percent, and fourthly, the shape memory alloy where the alloy composition of niobium and carbon $Nb/C \geqq 1$ in atomic ratio.

The invention provides, fifthly, a process for producing the shape memory alloy of any one of the aforesaid first to fourth inventions, the process characterized in that an alloy after making an ingot by adding niobium and carbon undergoes a heat treatment for homogenization at a temperature ranging from 1000° C. to 1300° C. and subsequently, an aging at a temperature ranging from 400° C. to 1000° C. to precipitate niobium carbide.

DETAILED DESCRIPTION OF THE INVENTION

The invention has the features as described above, and the embodiments of the invention are described below.

In the shape memory alloys of Fe—Mn—Si system containing Fe, Mn, and Si as principal constituents and further Cr or Cr and Ni as needed as principal constituents, the shape memory alloys of the invention are characterized in that niobium carbide is contained in the structure of the alloys. The shape memory alloys of the invention can develop a satisfactory shape memory effect without requiring troublesome, burdensome special treatment termed training in the related art because of the niobium carbide contained in the structure.

Addition of niobium (Nb) and carbon (C) to the structure of the alloy alone cannot develop this effect of the invention. The presence of niobium carbide, that is, the presence thereof as precipitate in the parent phase (austenite) cannot be missed for developing the effect.

The volume ratio of niobium carbide in the crystalline structure desirably ranges from 0.1 to 1.5 percent and more suitably from 0.3 to 1.0 percent.

The volume ratio less than 0.1 percent needs the training in order to expect development of the effect of the invention. On the other hand, exceeding 1.5 percent causes cutting workability to deteriorate; such alloys are unpreferred in view of practical use.

The chemical compositions (weight percent) of the shape memory alloys in general are considered as follows:

<Fe—Mn—Si>
Mn: 15 to 40
Si: 3 to 15
Fe: the rest

<Fe—Mn—Si—Cr>
Mn: 5 to 40
Si: 3 to 15
Cr: 1 to 20
Fe: the rest

<Fe—Mn—Si—Cr—Ni>
Mn: 5 to 40
Si: 3 to 15
Cr: 1 to 20
Ni: 0.1 to 20
Fe: the rest, and moreover,
Cu: ≦3 (ppm)
Mo: ≦2
Al: ≦10
Co: ≦30
N: ≦5000

Of course, unavoidable contamination of impurities is permitted.

The chemical compositions of the shape memory alloys of the invention containing niobium carbide are added with the following composition (weight percent) as a standard:

Nb: 0.1 to 1.5
C: 0.01 to 0.2

In any case, the volume ratio of niobium carbide formed of niobium and carbon preferably ranges from 0.1 to 1.5 percent as described above, and the atomic ratio of niobium to carbon Nb/C is preferably 1 or more and more preferably ranges from 1.0 to 1.2.

The preparation of the shape memory alloys of Fe—Mn—Si system that contain niobium carbide as described above is suitably carried out as follows: trace amounts of niobium and carbon are mixed together with specified element raw materials to make an ingot, subjected to a heat treatment for homogenization at a temperature ranging from 1000° C. to 1300° C. and subsequently, an aging at a temperature ranging from 400° C. to 1000° C. to allow precipitation of niobium carbide.

More suitably, the heat treatment for homogenization is carried out at a temperature of 1150° C. to 1250° C. for 5 to 20 hours, and the aging is carried out at a temperature of 700 to 900° C. for 0.1 to 5 hours.

Examples are described below, illustrating the invention in more detail.

EXAMPLES

Example 1

The alloys having the following three kinds of chemical compositions were produced by high frequency induction furnace.

(1) Fe—28Mn—6Si—5Cr—0.47Nb—0.06C (2) Fe—15Mn—5Si—9Cr—5Ni—0.47Nb—0.06C (3) Fe—14Mn—6Si—9Cr—5Ni—0.47Nb—0.06C

For these three kinds of alloys (1), (2), and (3), the treatment for homogenization was carried out at a temperature of 1200° C. for 10 hours, and subsequently the aging was carried out at a temperature of 800° C. for 2 hours.

The presence of niobium carbide was confirmed in all alloys (1), (2), and (3) after undergoing the aging treatment. The volume ratios thereof were about 0.5 percent.

FIG. 1 is an electron microscopic photograph showing the presence of niobium carbide in alloy (1) after undergoing the aging treatment. The niobium carbide appears as dark contrast in the photograph and has a particle size of about 20 nm. FIG. 2(A) is an electron diffraction pattern proving this; diffraction spots with weak intensity shown by arrows are those produced from niobium carbide. FIG. 2(B) shows a key diagram of the diffraction pattern.

For comparison, an Fe—28Mn—6Si—5Cr alloy [alloy (4)] was produced by high frequency induction furnace and subjected only to the homogenization treatment similar to that described above. In alloy (4) containing no niobium and carbon, as a matter of course, the presence of niobium carbide is not confirmed at all.

With alloys (1), (2), and (3) after undergoing the aging and alloy (4) for comparison, the shape memory effect thereof was evaluated through a bend test. Test pieces for the test were plates of 0.6 mm (in thickness)×4 mm×30 mm.

FIG. 3 shows the results of the test; the shape recovery ratios in application of 4 and 6 percent of bending deformation are shown. The recovery ratios were found to be 60 percent or more in alloys (1), (2), and (3) and particularly, to be 90 percent or more in alloy (1).

On the other hand, the recovery ratio of the reference alloy (4) was as low as 40 percent. Various comparative alloys having different structures were examined, but the recovery ratios thereof were 50 percent at highest.

Example 2

Similarly to Example 1, the following alloys of the invention were prepared:

(1) Fe—28Mn—6Si—5Cr—NbC
(The volume ratio of NbC: 0.5 percent)

(2) Fe—15Mn—5Si—9Cr—5Ni—NbC
(The volume ratio of NbC: 0.5 percent)

The following alloy for comparison was prepared:

(4) Fe—28Mn—6Si—5Cr

For these alloys (1), (2), and (4), the shape memory effects of test pieces having the size of 0.4–0.6 mm×4 mm×15 mm were evaluated through a tensile test. Results are shown in FIG. 4. The tensile deformations are indicated on the abscissa axis, and the shape recovery ratios are indicated on the ordinate axis.

It is confirmed that alloys (1) and (2) of the invention have a satisfactory shape memory effect.

In FIG. 5, shape recovery stresses are plotted against shape recovery strains wherein the pre-strains are from two to five percent. In FIG. 5, the stresses (recovery forces) generated when the shapes are recovered by the strains indicated on the abscissa axis are indicated on the ordinate axis. Signs A to E used therein indicate the following.

A: Alloy (1) of pre-strain 2.1 percent

B: Alloy (1) of pre-strain 4.1 percent

C: Alloy (1) of pre-strain 5.5 percent

D: Alloy (2) of pre-strain 5.0 percent

E: Alloy (4) of pre-strain 3.1 percent

Comparative Example

FIG. 5 reveals that alloys (1) and (2) of the invention acquire very large recovery forces as compared with comparative alloy (4) in the related art.

As described above in detail, in the invention the shape memory effect can be easily developed simply by the heat treatment for aging without carrying out a complicated thermomechanical treatment termed training as in the related art. The shape memory alloys of the invention can be applied to all alloy parts having various shapes, different from alloys in the related art that require the training treatment. For example, the alloys of the invention can be used for clamping members (water pipes, gas pipes, petroleum transporting pipes, etc.) and require no clamping by weld. This can eliminate dangers such as weakening or corroding welding areas produced by weld.

Figure 1:
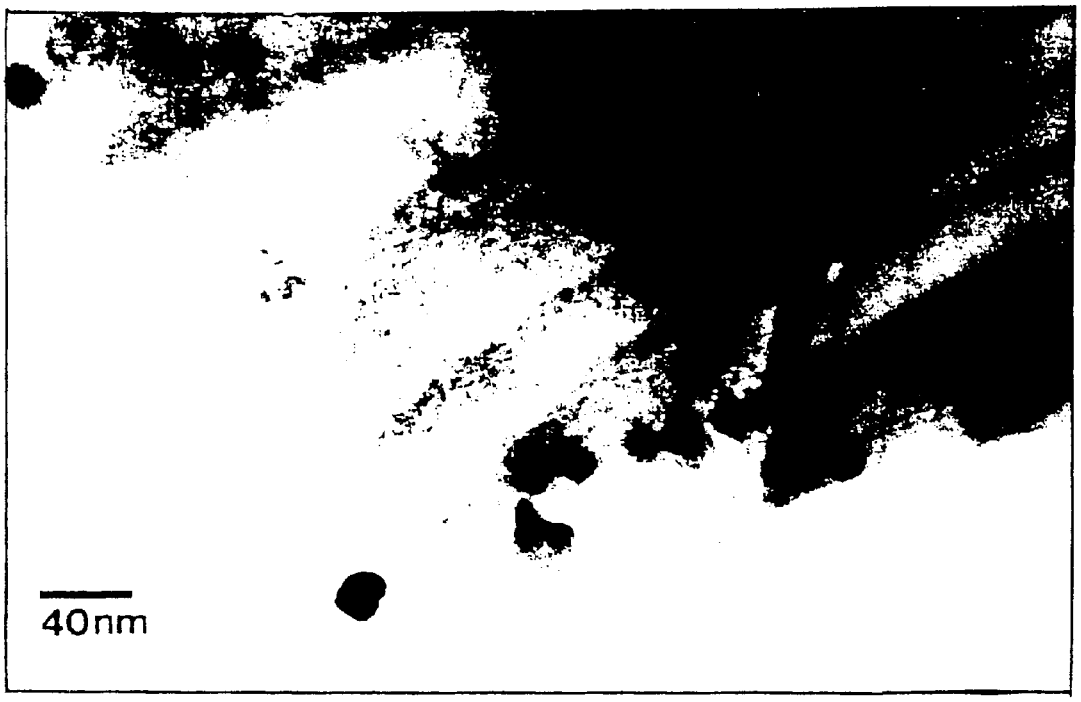
FIG. 1 is an electron microscopic photograph used in place of a drawing which shows the structure of the alloy of the invention in Example 1.
Figure 2:
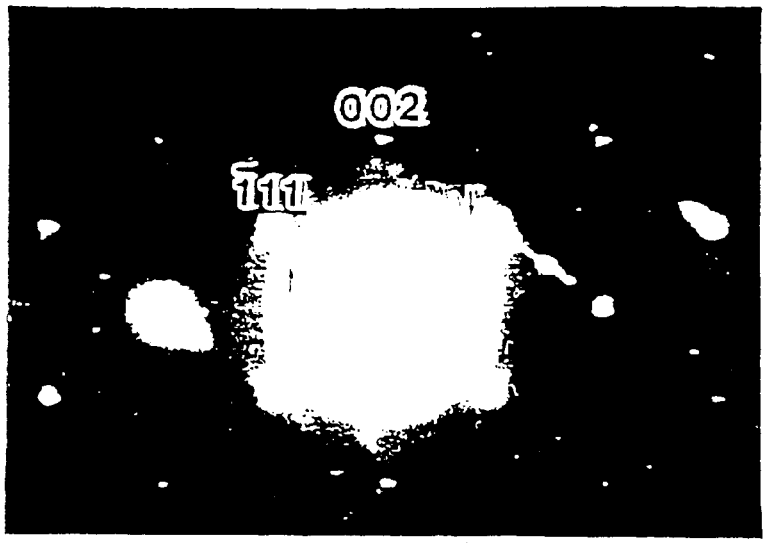
FIG. 2(A) is an electron diffraction pattern used in place of a drawing which shows the presence of niobium carbide corresponding to FIG. 1
FIG. 2(B) is a key diagram.
Figure 2:
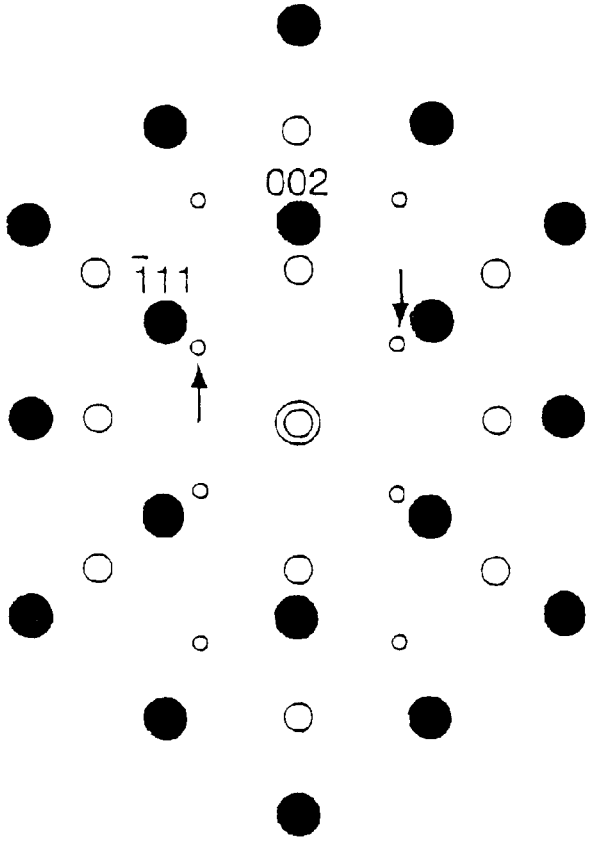
Figure 3:
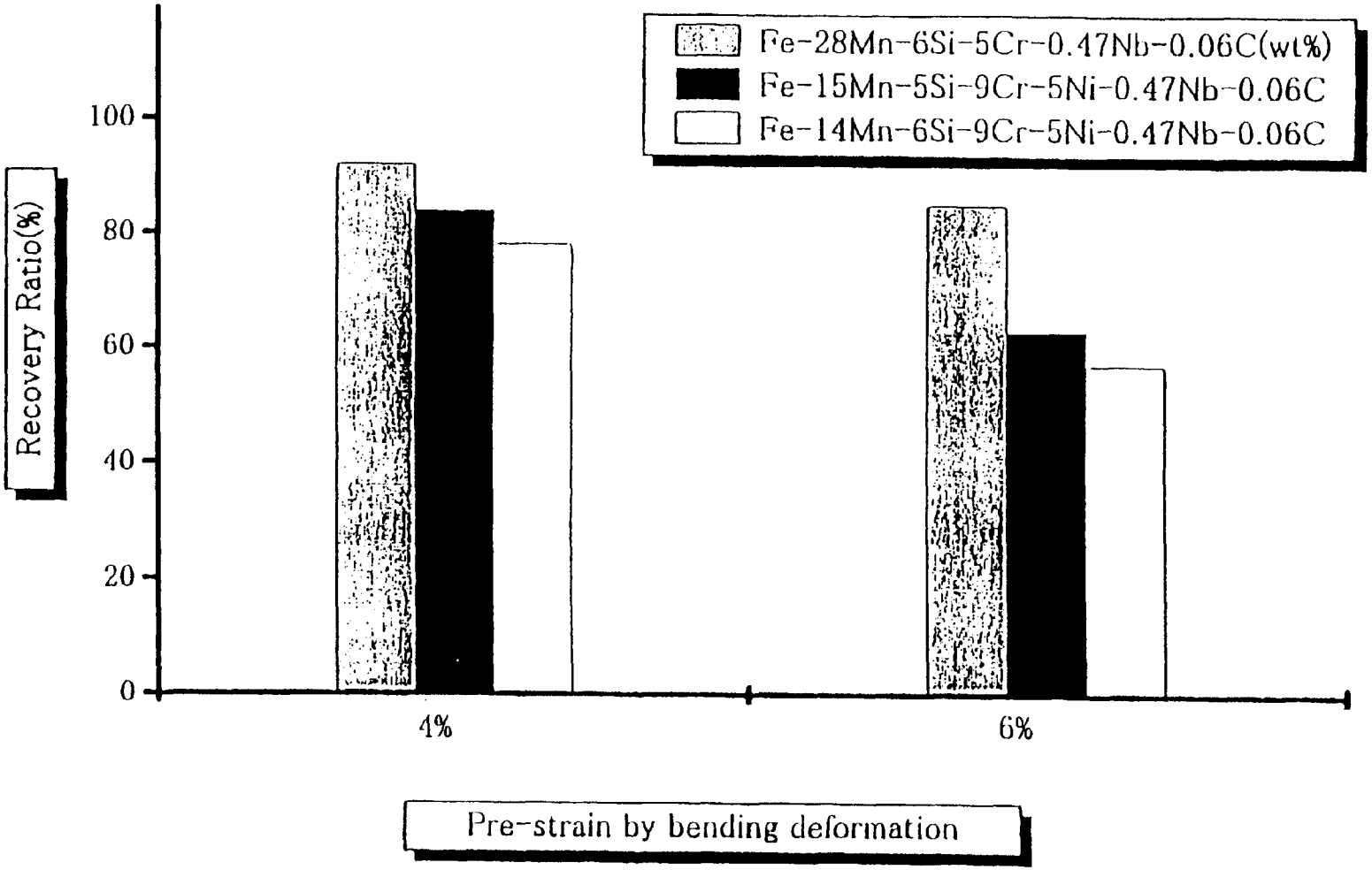
FIG. 3 is a diagram showing the results of the bend test.
Figure 4:
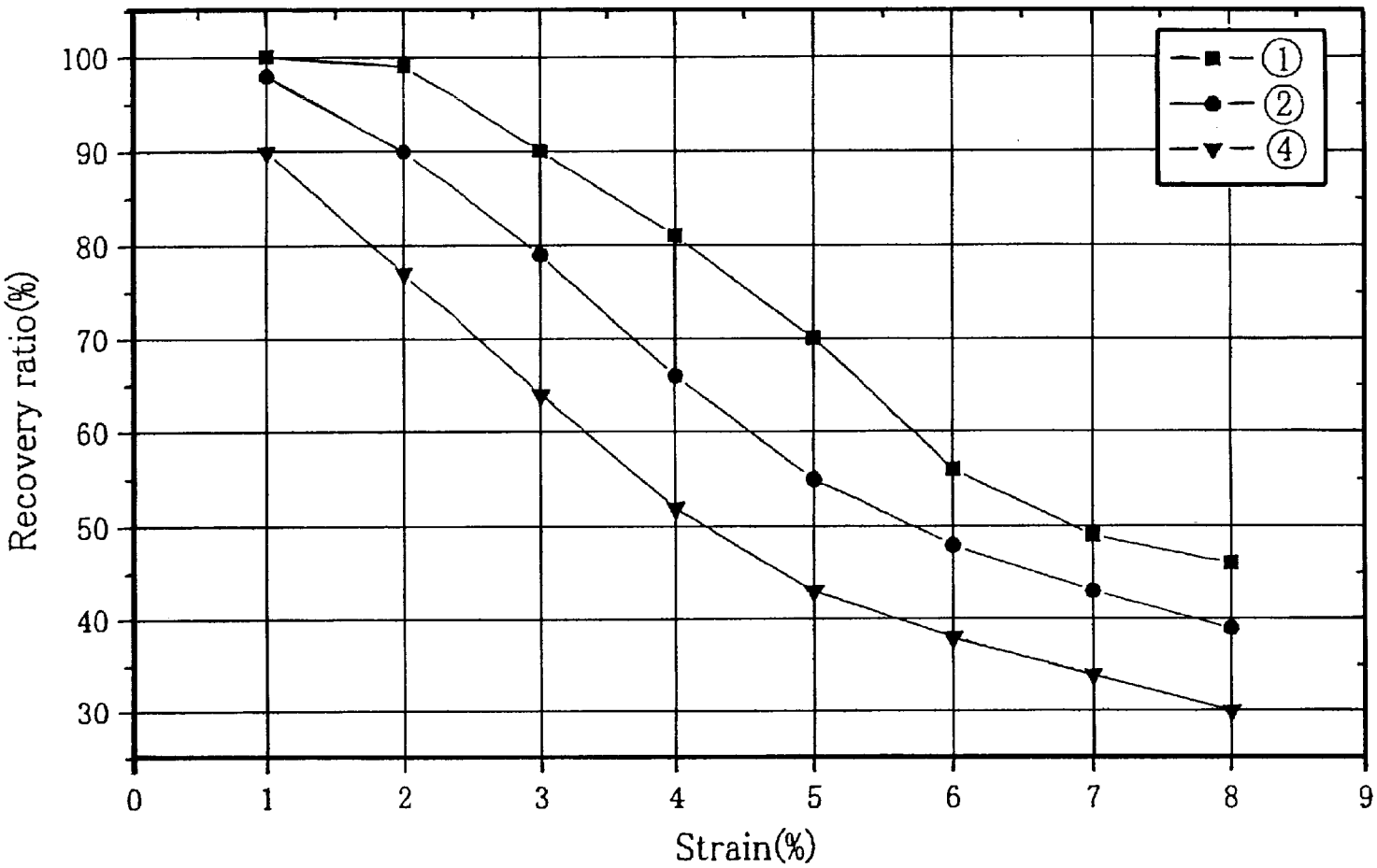
FIG. 4 is a diagram showing the results of the tensile test.
Figure 5:
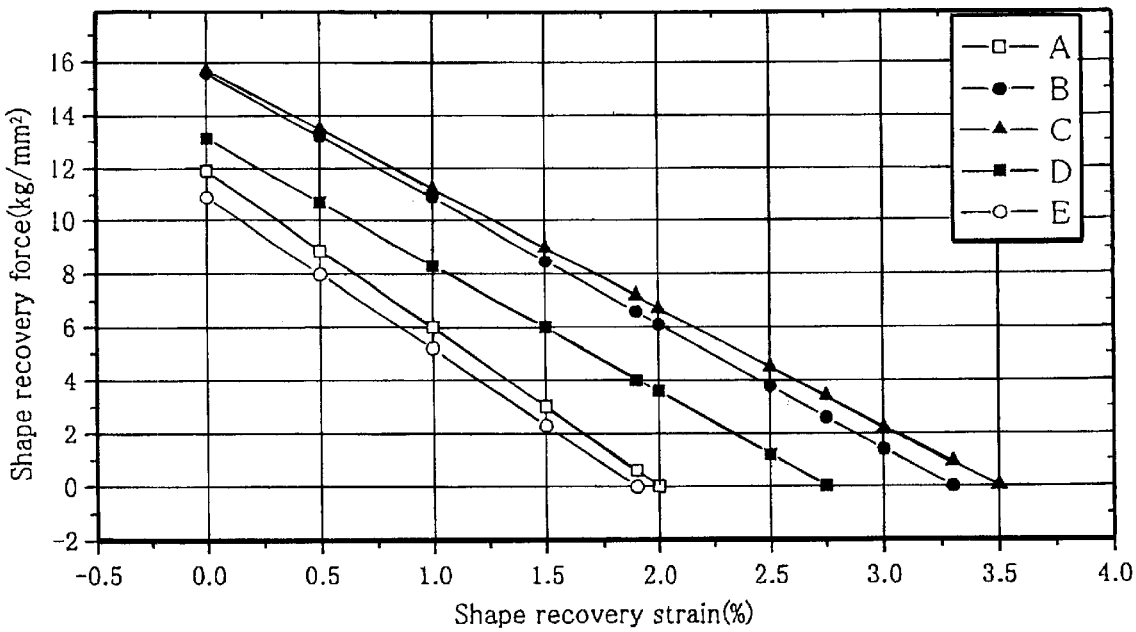
FIG. 5 is a diagram showing the relation between the shape recovery stress and shape recovery strain.

What is claimed is:

1. A shape memory alloy of Fe—Mn—Si system containing, in weight %, Mn: 15–40, Si: 3–15, Nb: 0.1–1.5, C: 0.01–0.2 and the balance of Fe and unavoidable impurities, wherein niobium carbide is contained at 0.1–1.5 volume percent.

2. A shape memory alloy of Fe—Mn—Si—Cr system containing, in weight %, Mn: 5–40, Si: 3–15, Cr: 1–20, Nb: 0.1–1.5, C: 0.1–0.2 and the balance of Fe and unavoidable impurities, wherein niobium carbide is contained ay 0.1–1.5 volume percent.

3. A shape memory alloy of Fe—Mn—Si—Cr—Ni system containing, in weight %, Mn: 15–40, Si: 3–15, Cr: 1–20, Ni: 0.1–20, Nb: 0.1–1.5, C: 0.01–0.2 and the balance of Fe and unavoidable impurities, wherein niobium carbide is contained at 0.1–1.5 volume percent.

* * * * *